US005271203A

United States Patent [19]

Nagle

[11] Patent Number: 5,271,203

[45] Date of Patent: Dec. 21, 1993

[54] SUPPORT FORM FOR A SETTABLE MATERIAL

[76] Inventor: Joseph J. Nagle, 165 Ten Rod Rd., Rochester, N.H. 03867

[21] Appl. No.: 779,945

[22] Filed: Oct. 21, 1991

[51] Int. Cl.[5] ..... E04C 3/34

[52] U.S. Cl. ..... 52/725; 52/296; 52/294; 52/298

[58] Field of Search ..... 52/294, 725, 296, 298, 52/227, 231, 297, 724, 731, 98; 249/13, 18, 19

[56] References Cited

U.S. PATENT DOCUMENTS

| | | | |
|---|---|---|---|
| 2,945,659 | 7/1960 | McDonald | 52/98 X |
| 2,948,995 | 8/1960 | Cogan | 52/231 |
| 2,978,780 | 4/1961 | Clarkson | 52/297 |
| 3,257,765 | 6/1966 | Anderson | 52/298 |
| 3,400,905 | 9/1968 | Van Dusen | 52/296 X |
| 3,563,502 | 2/1971 | Dayson | 52/98 |
| 3,879,907 | 4/1975 | Olson | 52/297 |
| 4,048,776 | 9/1977 | Sato | 52/297 |
| 4,673,157 | 6/1987 | Wells | 52/296 X |

*Primary Examiner*—Carl D. Friedman
*Assistant Examiner*—Beth A. Aubrey
*Attorney, Agent, or Firm*—Davis, Bujold & Streck

[57] ABSTRACT

An elongate hollow support form having a continuous surface disposed about a central longitudinal axis and having opposed first and second opened ends and a first annular member, attached to the second opened end, for anchoring the elongate support form once the form has been positioned and a pourable setting material has been poured into the confines of the form. The first annular member forms a base section for supporting the support member and defines a cavity for accommodating the material. A second annular member can be provided adjacent the first end of the support form. After the pourable setting material has set inside the form, pourable setting material and the form become an integral structure.

12 Claims, 3 Drawing Sheets

FIG. 1
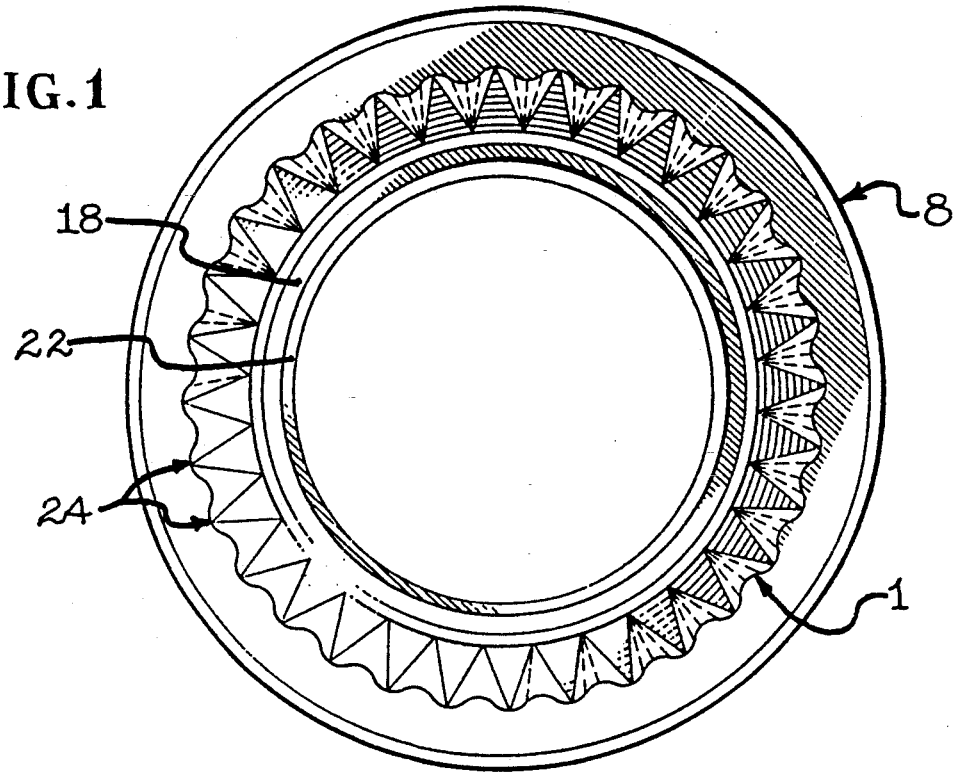
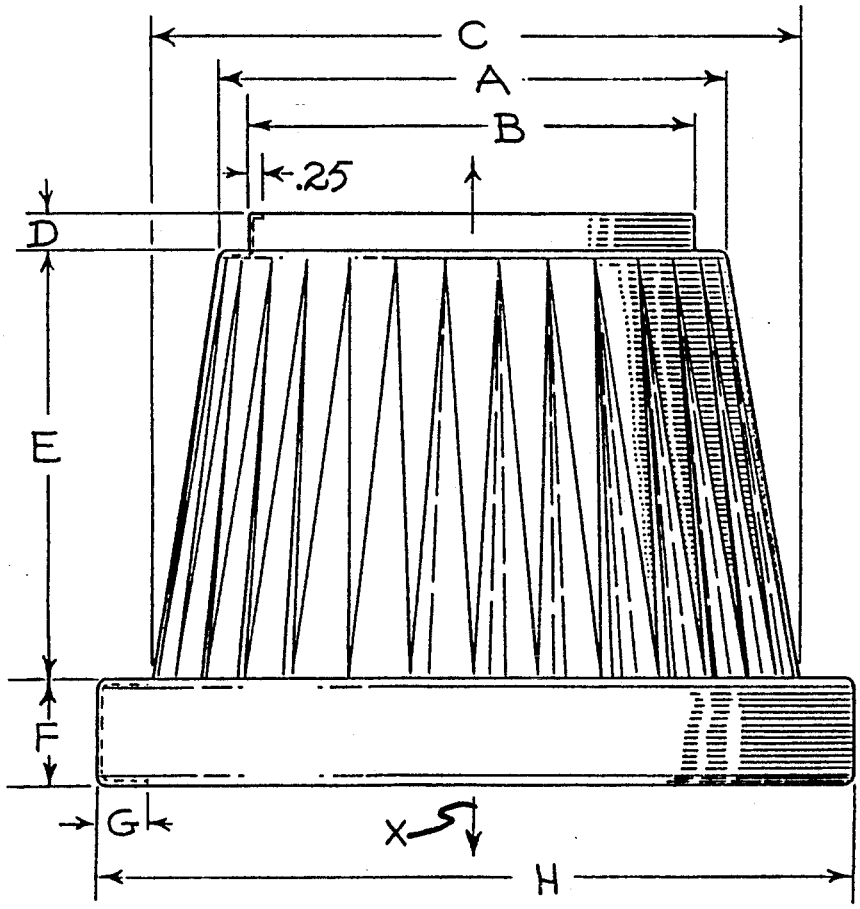
FIG. 5

SUPPORT FORM FOR A SETTABLE MATERIAL

The present invention related to improvements concerning a support form for shaping and encasing a pourable settable material into a desired configuration which, once properly positioned and sufficiently set, will resist shifting and/or tipping.

BACKGROUND OF THE INVENTION

Support forms are known in the prior art to provide an envelope or enclosure for a pourable settable material as it hardens into a structural base support for flagpoles, basketball backboards, fences and the like. The pole or other structural element has a first end thereof positioned within the confines of the form and the second end of the structural element extends out of the form. Thereafter, the pourable material is then added to the support form which, once it hardens around the first end of the structural element, forms a rigid, integral structure therewith.

For underground applications, that is, in applications in which the support is placed either partially or wholly beneath ground level, a number of problems exist in known prior art apparatuses. First, conventional support forms such as SONATUBE TM are shaped so as to have a relatively constant cross-section along the length of the form. Forms having this geometry, when positioned either partially or wholly below ground level, are subject to tipping or leaning as a result of settling or frost heaving, that is the upthrust of ground which occurs due to the freezing of the soil, typically seen in the colder climates during the winter months. The net effect of the shifting ground against or adjacent a form of relatively constant cross-section along its length is that the form, and the structural element encased therein, either tilts to a side or is pushed toward the surface thus degrading the structural capacity for which the support was intended.

A second problem which occurs in conventional forms of this type is that as the material is poured into the confines of the form, after the form has been positioned within the hole, the pourable material tends to seep between the bottom of the form and the ground and tends to push or lift at least a portion of the form toward ground level. This seepage may occur unevenly so as to tip or tilt the support to one side.

Wherefore, it is an object of the present invention to provide a support form having a cross-sectional design which lessens the effects of frost heaving to produce thereby a more sturdy support which will not degrade during the change of seasons.

A further object of the invention is to provide a support form having an annular anchoring means to allow the form to seat properly prior to and while pourable material is being poured into the form and to minimize shifting, tipping or leaning caused by frost and/or other environmental factors.

A still further object of the present invention is to provide a form having a design which facilitates the storage of a plurality of forms, prior to use, by allowing them to nest one within the another.

SUMMARY OF THE INVENTION

According to the invention, there is provided a support form for shaping and encasing a pourable settable material comprising a hollow elongate section having a substantially continuous exterior surface with opposed first and second opened extremities, the elongate section defining a longitudinal axis of the support form; and anchoring means, attached adjacent the second extremity, for stabilizing and anchoring the elongate section in use.

In a preferred embodiment, there is provided a support form for shaping and encasing a pourable settable material comprising a hollow elongate section having a substantially continuous exterior surface with opposed first and second opened extremities, the elongate section defining a longitudinal axis of the support form, the elongate section being a truncated, substantially conical section having a first circular end, a second circular end with a continuous sloping surface therebetween, and the diameter of the second end being substantially larger than the diameter of the first end; a first annular portion being connect to said second end, said annular portion comprises a first section connected to a peripheral edge of the second end and extending radially outwardly from the longitudinal axis, a cylindrical side section being connected to a outer peripheral edge of the first section and extending substantially parallel to the longitudinal axis away from the elongate section and a lip section being connected to a second peripheral edge of the cylindrical side section and extending radially inwardly therefrom toward the longitudinal axis, and the first section, the cylindrical side section and the lip section forming a material receiving recess; and a second annular portion having a first section connected adjacent the first end and extending radially inwardly toward the longitudinal axis, a cylindrical member connected to and extending from a inner peripheral edge of the first section, said cylindrical member extends substantially parallel to the longitudinal axis away from the conical section, and a second section connected to and extending from a second edge of the cylindrical member substantially radially inwardly toward said longitudinal axis.

BRIEF DESCRIPTION OF THE DRAWINGS

The preferred embodiment of the invention will now be described, by way of example, with reference to the accompanying drawings in which:

FIG. 1 is a plan view of the support form of the present invention;

FIG. 5 is a front elevational view of the support form of FIG. 1.

DETAILED DESCRIPTION OF THE INVENTION

Figure 2:
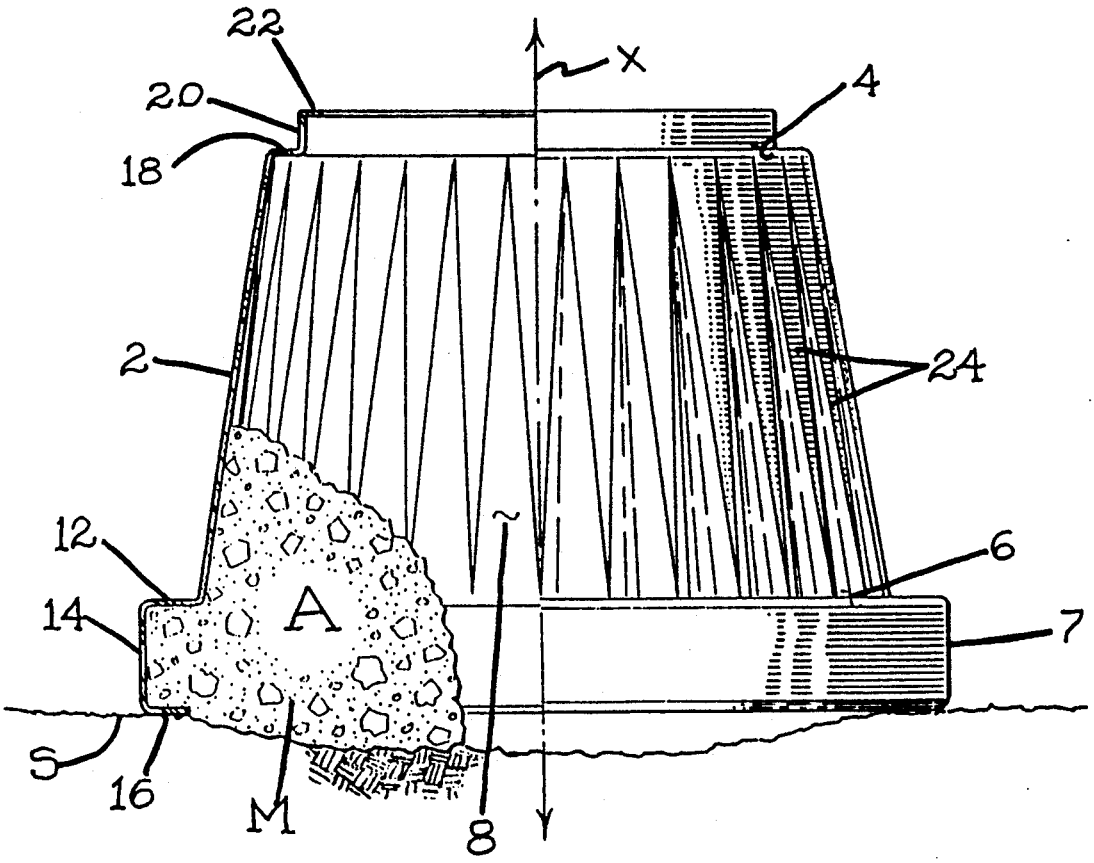
FIG. 2 is a diagrammatic side elevational view, shown partly in cross section, of the support form of FIG. 1.
Figure 3:
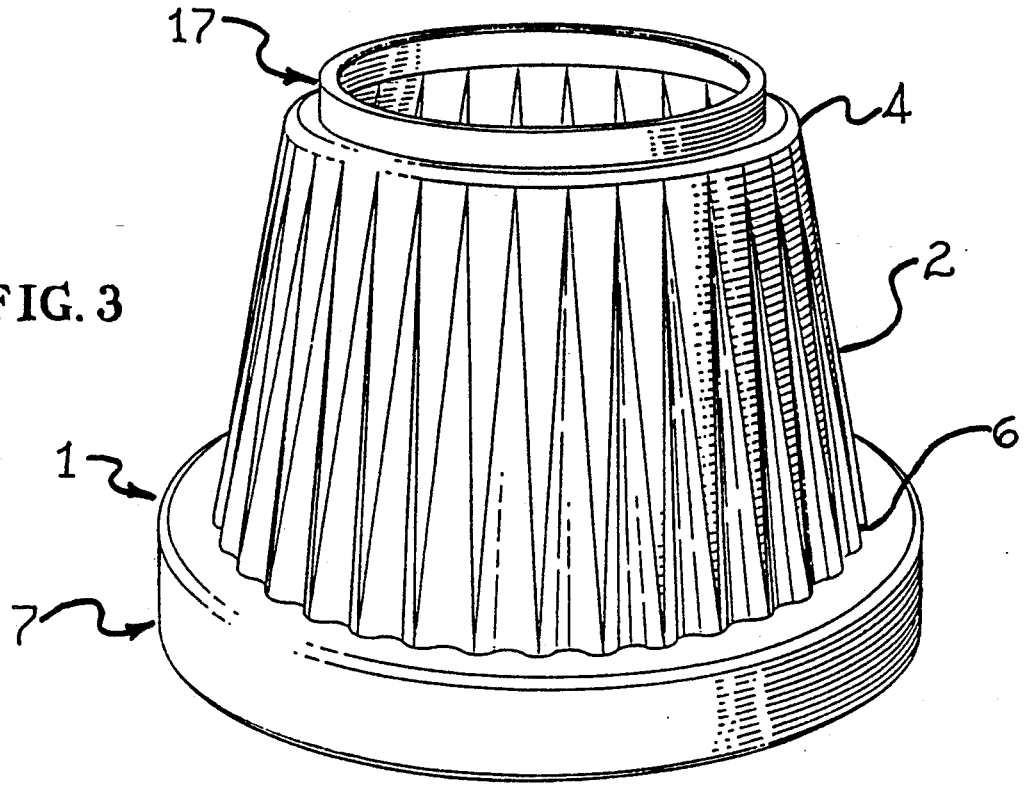
FIG. 3 is a perspective view of the support form of FIG. 1.
Figure 4:
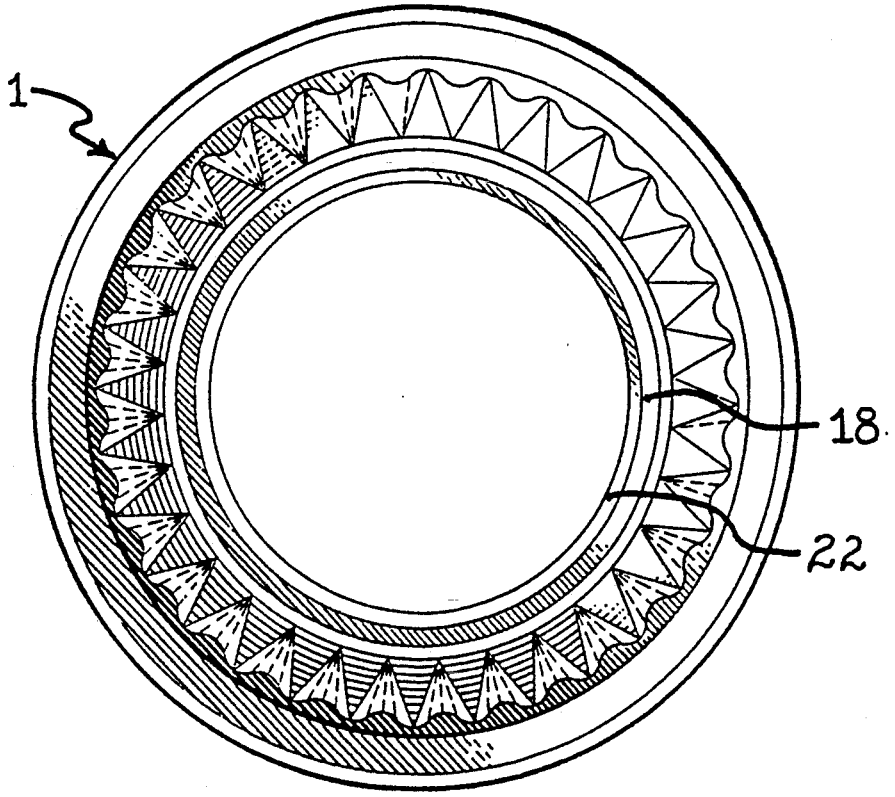
FIG. 4 is a bottom plan view of the support form of FIG. 1.

Turning now to FIGS. 1 through 5, the features of the support form of the present invention can be seen and will be discussed in detail hereinafter. The support form 1 is a hollow elongate member typically made from a non-porous material, such as high density polyethylene, which resists the migration of water or other fluids into the support form's interior and exterior surfaces. The support form, due to it being made from polyethylene, is a substantially permanent form which results in an impermeable barrier between the pourable material and the environment. The support form 1 has a truncated substantially-conically shaped section 2 having a first opened circular extremity or end 4 and an opposed second opened circular extremity or end 6 and a sloping continuous surface 8 extending therebetween. The diameter of the second circular end 6 is substantially larger than the diameter of the first circular end 4, on the order of 10 to 40 per cent or more, thereby forming a divergent substantially conical section. The support form defines a central longitudinal axis X (see FIG. 2) which passes through the centers of the first and second circular end 4 and 6, respectively.

The conical shape of the form provides greater resistance to the effects of frost heaving in comparison with previously known designs and structures. It should be noted that other curvilinear geometries wherein the elongate member has a varying cross-section from one extremity to the other, will also provide a level of protection from the effects of frost heaving and other environmental factors.

Connected to the second end 6 of the conical section 2 is a first annular channel or portion 7, the function of which is to anchor and weight the support form 1 once it has been set into a hole, either partially or wholly below ground level, and a material has been poured into the form. The annular portion 7 comprises a first section 12 extending radially outwardly from the periphery of the second end 6 of the form. Connected to an outer peripheral edge of the first section 12 is a cylindrical side section 14 which extends substantially parallel to the longitudinal axis X, away from the conical section 2, and has a length of from about 5 to 35 per cent, preferably 15 to 25 per cent, of the longitudinal length of the conical section 2. The cylindrical side section 14 has a lip section 16 connected to its other peripheral edge which extends radially inwardly toward the longitudinal axis X of the support form. Typically, depending on the size of the support form, the annular portion 7 extends radially outwardly at least 0.75 inches, thereby allowing the annular portion to have a diameter of at least 1.5 inches greater than that of the second edge. The lip section 16 forms a base for the support form 1 which allows it to rest vertically in a hole or on the ground in intimate contact therewith. The annular portion 7 is disposed circumferentially about the longitudinal axis X and it defines a recessed area or cavity A (see FIG. 2) which serves as the anchor for the support form once material M is poured into the support form, via the first end, and allowed to set.

The lip section 16, once material is received by the cavity A, is maintained in intimate contact with a supporting surface S, such as the ground, and prevents material M from seeping or flowing beneath the support form and causing it to lift or tilt from its initially set position. In addition, the annular portion 7 serves the further functions of stabilizing the support form 1 due to its increased diameter at the base of the form and increases the load-bearing capability of the form.

The support form also has a second annular portion 17 comprising a first section 18 connected to the periphery of the first end 4 and extending radially inwardly toward the longitudinal axis X and disposed circumferentially with respect thereto. A cylindrical member 20 is connected to an inner peripheral edge of the first section 18 and disposed circumferentially about the longitudinal axis X. The cylindrical member 20 extends away from the conical section 2 substantially parallel to the longitudinal axis X. A second section 22 is connected to the other peripheral edge of the cylindrical member 20 and this section extends radially inwardly toward the longitudinal axis X.

Typically, the first section 18 has a length of at least 0.5 inches, the cylindrical member 20 has a length of approximately 0.75 inches and the second section 22 has a length of about 0.25 inches. However, depending on the application of the support form, the lengths and dimensions of the support form may vary.

In the disclosed embodiment, a plurality of longitudinal ribs 24 are formed in the conically shaped section 2 to provide additional strength thereto and thereby minimize deflection of the wall from pressure exerted by the weight of concrete. The ribs are formed within the sloping surface 8, extend parallel to the longitudinal axis X and are equally spaced circumferentially about the support form. The number and spacing of the ribs is not critical and may vary depending on the application and the type pourable material to be utilized. In the shown embodiment, thirty-two ribs are provided.

Two sets of typical dimensions for the form shown in FIG. 5 of the drawings are as follow:

| Form | A | B | C | D | E | F | G | H | I |
|---|---|---|---|---|---|---|---|---|---|
| 1 | 7.86 | 6.86 | 10.0 | 0.6 | 6.4 | 1.4 | 0.8 | 11.8 | 0.25 |
| 2 | 9.82 | 8.57 | 12.5 | 0.75 | 8.0 | 1.75 | 1.0 | 14.75 | 0.25 |

The wall thickness is typically between 0.03–0.04 inches and the weight of the form is typically between 0.4–0.8 pounds.

Certain changes made be made in the support form of the present invention without departing from the spirit and scope of the invention herein disclosed. Thus, it is intended that all of the subject matter contained in the above description or shown in the accompanying drawings shall be interpreted as merely illustrating the inventive concept herein involved and not construed as limiting the invention.

Wherefore, I claim:

1. A vertical support form for shaping and encasing a pourable settable material comprising:

a hollow vertical elongate section having a substantially continuous exterior surface with opposed top and bottom open ends, the elongate section defining a vertical longitudinal axis of the support form;

anchoring means being attached adjacent the bottom end of the support form, said anchoring means having a lip section defining the opening of the bottom end and forming a base for supporting the support form;

wherein said anchoring means comprises a first annular portion comprising a first annular section having inner and outer peripheral edges, said inner peripheral edge is connected to a peripheral edge of the bottom of the elongate section, and said first annular section extends radially outwardly away from the longitudinal axis, a first cylindrical side section having first and second peripheral edges, said first peripheral edge is connected to said outer peripheral edge of the first annular section of the first annular portion, and said first cylindrical side section extends substantially parallel to the longitudinal axis away from the elongate section, and the lip section has an outer peripheral edge connected to said second peripheral edge of the first cylindrical side section and extends radially inwardly therefrom toward the longitudinal axis, and the first annular section, the cylindrical side section and the lip section form a material receiving recess for captively retaining and encasing a portion of the pourable settable material.

2. A support form according to claim 1 wherein the top and bottom open ends are circular and the longitudinal axis extends through the centers of the top and bottom open ends.

3. A support form according to claim 1 further comprising a second annular portion comprising a first annular section having inner and outer peripheral edges, said outer peripheral edge is connected to a peripheral edge of the top of the elongate section and extends radially inwardly toward the longitudinal axis.

4. A support form according to claim 3 wherein the second annular portion further comprises a second cylindrical member having a first peripheral edge connected to and extending from an inner peripheral edge of the first annular section of the second annular portion, said second cylindrical member extends substantially parallel to the longitudinal axis away from the elongate section.

5. A support form according to claim 4 wherein the second annular portion further comprises a second annular section having an outer peripheral edge connected to and extending away from a second peripheral edge of the second cylindrical member substantially radially inwardly toward said longitudinal axis.

6. A support form according to claim 1, wherein the support form is made from a substantially lightweight and non-porous material.

7. A support form according to claim 1 wherein the non-porous material is high density polyethylene.

8. A support form according to claim 1 wherein longitudinal rib members are circumferentially formed in the sloping surface of the conical section.

9. A support form according to claim 7 wherein the conical section has a thickness of from about 0.03 to 0.04 inches.

10. A support form according to claim 1 wherein the lip section of the first annular portion extends radially inwardly toward the longitudinal axis at least 0.75 inches.

11. A support form according to claim 10 wherein the cylindrical side section of the first annular portion has a length of about 1.5 inches.

12. A vertical support form for shaping and encasing a pourable settable material comprising:

a hollow vertical elongate section having a substantially continuous exterior surface with opposed top and bottom open ends, the elongate section defining a vertical longitudinal axis of the support form;

anchoring means being attached adjacent the bottom end of the support form, said anchoring means having a lip section defining the opening of the bottom end and forming a base for supporting the support form;

wherein said anchoring means comprises a first annular portion comprising a first annular section having inner and outer peripheral edges, said inner peripheral edge is connected to a peripheral edge of the bottom of the elongate section, and said first annular section extends radially outwardly away from the longitudinal axis, a first cylindrical side section having first and second peripheral edges, said first peripheral edge is connected to said outer peripheral edge of the first annular section of the first annular portion, and said first cylindrical side section extends substantially parallel to the longitudinal axis away from the elongate section, and the lip section has an outer peripheral edge connected to said second peripheral edge of the first cylindrical side section and extends radially inwardly therefrom toward the longitudinal axis, and the first annular section, the cylindrical side section and the lip section form a material receiving recess for captively retaining and encasing a portion of the pourable settable material;

a second annular portion comprises a first annular section having inner and outer peripheral edges, said outer peripheral edge is connected to a peripheral edge of the top of the elongate section, and said first annular section of said second annular portion extends radially inwardly toward the longitudinal axis; a second cylindrical member having first and second peripheral edges, said first peripheral edge is connected to and extends from said inner peripheral edge of the first annular section of the second annular portion, said second cylindrical member extends substantially parallel to the longitudinal axis away from the elongate section, and a second annular section of the second annular portion has an outer peripheral edge connected to and extending away from said second peripheral edge of the second cylindrical member substantially radially inwardly toward said longitudinal axis.

* * * * *